United States Patent [19]

Van Ruymbeke

[11] Patent Number: 4,729,748

[45] Date of Patent: Mar. 8, 1988

[54] FLYING TOY

[76] Inventor: Gerard Van Ruymbeke, 30, boulevard Chancel, 13008 Marseille, France

[21] Appl. No.: 855,684

[22] Filed: Apr. 25, 1986

[30] Foreign Application Priority Data

Apr. 26, 1985 [FR] France ..... 85 06523

[51] Int. Cl.[4] ..... A63H 27/00

[52] U.S. Cl. ..... 446/35; 446/121; 446/376; 446/391

[58] Field of Search ..... 446/35, 120, 121, 376, 446/391

[56] References Cited

U.S. PATENT DOCUMENTS

| | | | |
|---|---|---|---|
| 262,686 | 8/1882 | Meyers | 446/35 |
| 829,660 | 8/1906 | Lewkowicz | 446/35 |
| 1,031,623 | 7/1912 | Colombier | 446/35 |
| 2,814,907 | 12/1957 | Sears . | |
| 3,626,555 | 12/1971 | Albertini et al. . | |
| 3,774,339 | 11/1973 | Swett | 446/121 |
| 4,536,165 | 8/1985 | Maar | 446/376 X |

FOREIGN PATENT DOCUMENTS

| | | |
|---|---|---|
| 1604345 | 11/1971 | France . |
| 2131115 | 11/1972 | France . |
| 2374928 | 7/1978 | France . |

*Primary Examiner*—Joseph Falk

*Attorney, Agent, or Firm*—Sandler & Greenblum

[57] ABSTRACT

A flying toy which can move through the air by flapping its wings which consists of a body having at least one opening, at least one flexible wing connected to the body which can flap to move the flying toy through the air, and an elastic band for storing power for flapping the at least one flexible wing. The toy also includes an activation assembly connected to the elastic band for activating the flapping of the at least one flexible wing by the elastic band. The at least one oscillating wing base is secured to the at least one flexible wing through the at least one opening. The toy also includes a wind-up assembly for winding the elastic band and a latching assembly for neutralizing the activation assembly before the flying toy is released to fly. The latching assembly is constructed and arranged such that activation of the flying toy to cause flight can be accomplished using only one hand.

19 Claims, 17 Drawing Figures

FIG. 10.
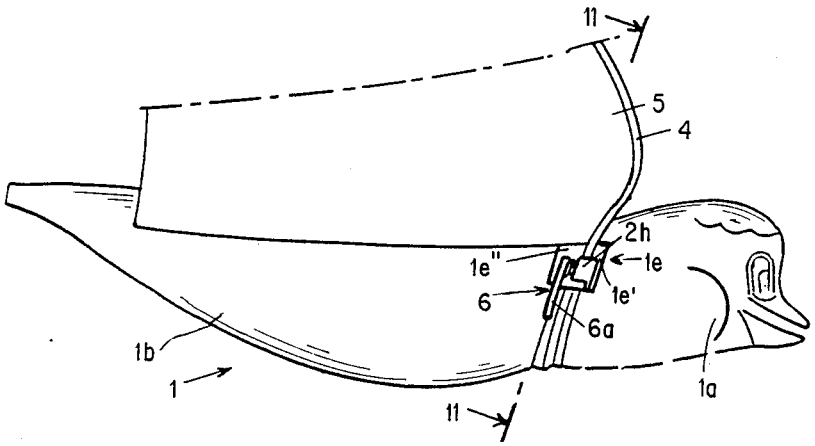
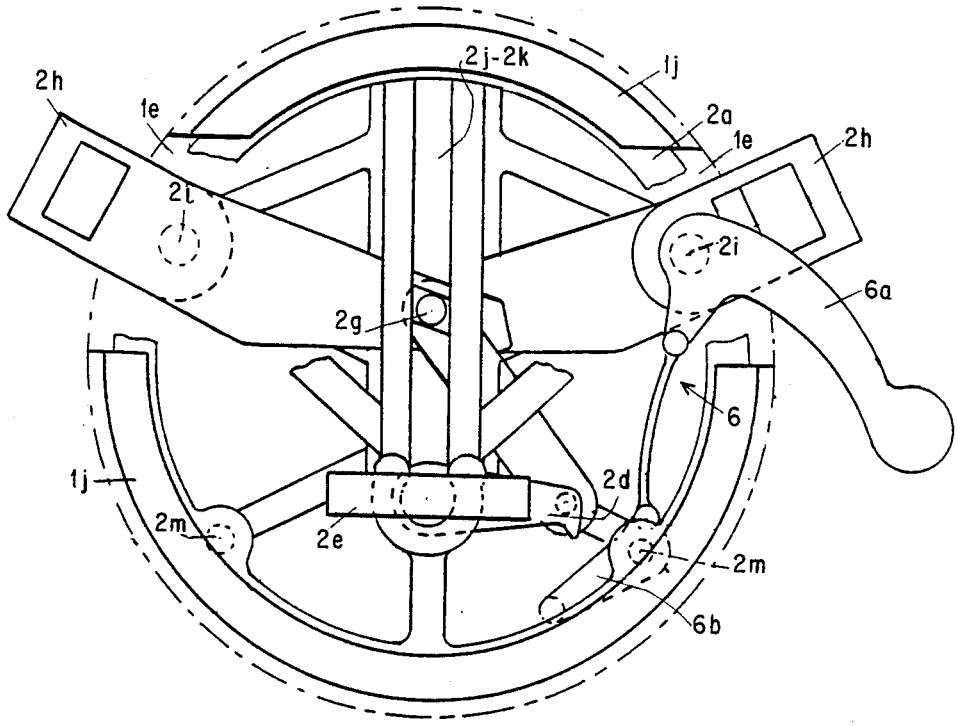
FIG. 11.

FIG. 12.
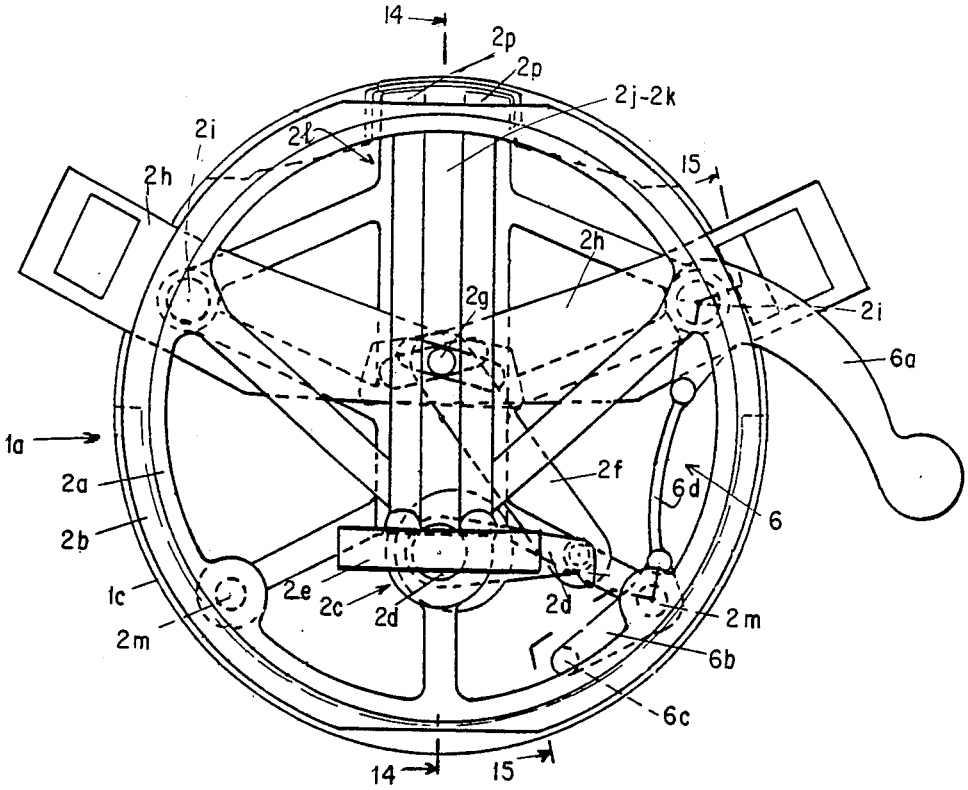
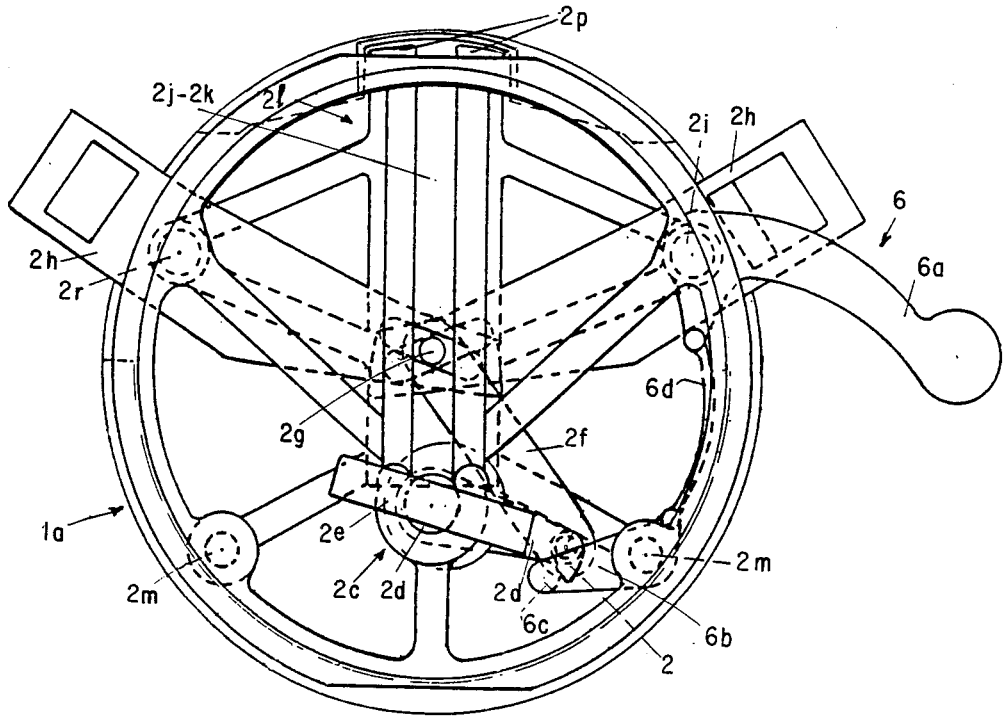
FIG. 13.

FIG. 14.
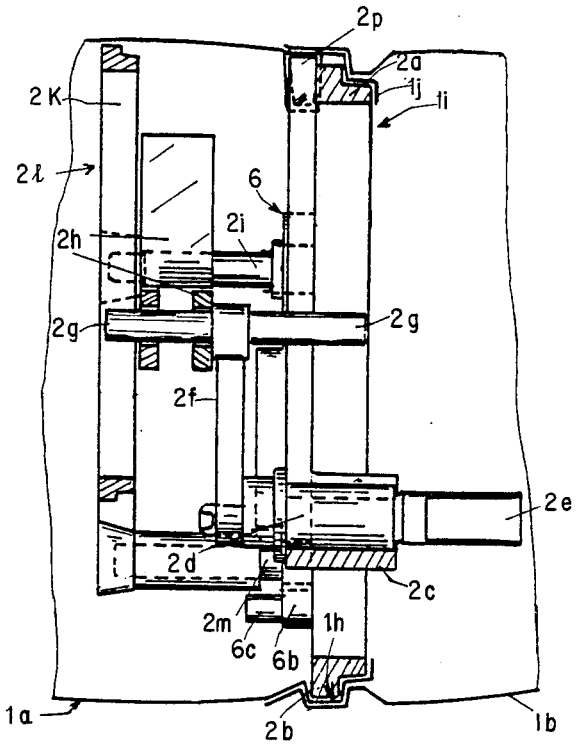
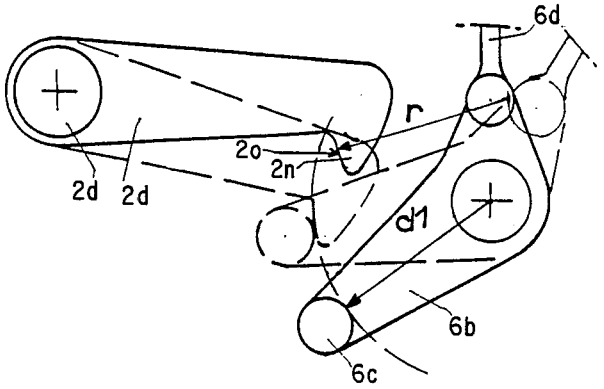
FIG. 17.

FLYING TOY

BACKGROUND OF THE INVENTION

1. Field of the Invention

The present invention relates to a flying toy, the appearance of which is made to imitate a bird. The flying toy is adapted to move in the air by flapping its wings in the manner which imitates the flight of the bird.

2. Description of Background Materials and Prior Art

A flying bird of the general type of the invention is described in French Patent No. 1,604,345. The flying bird according to this patent consists of a hollow body having an elongated configuration formed of two nested portions. The front portion of the bird includes a mechanism for activating the movement of the wings by means of an elastic band. The elastic bird furnishes the motor force. Two flexible wings are fixed to the activation mechanism and to the body of the bird. A wind-up system, by which it is possible to twist the rubber band motor, is installed in the rear portion of the body. The rear portion of the body further includes a orientable tail fin which serves as a rudder. A latching apparatus or stop lever is provided which makes it possible to lock the activation mechanism of the wings during wind-up and before the toy is released to fly.

According to this patent, the activation mechanism of the wings is installed within the body in the vicinity of the location where the two portions, front and rear, nest. The activation mechanism includes two oscillating levers or winged bases which traverse two lateral slots within the body in front of the nesting of the front and rear portions of the body. Each of these oscillating levers or wing bases are adapted to be connected to a wing beam. The front edge of the flexible flap is attached to the wing beam, which constitutes the wings of the flying toy.

According to the present modes of execution of flying toys of this type, the manipulation shaft of the stop lever traverses, or passes through, a third slot provided in the lower portion, or base, of the body, in front of the point where the front and rear portions of the body are nested one within the other, at the position which corresponds to the neck of the toy bird.

The presence of this third slot in the base of the body and the arrangement of the manipulation shaft of the stop lever beneath the body presents several disadvantages. The presence of this lower slot in the body may cause the penetration of dirt, sand or other undesirable particles in the body of the toy bird during its landing. Further, the lower slot weakens the rigidity of the body of the toy bird. Additionally, the manipulation shaft of the stop lever positioned under the body forms a projection which can be openly exposed to shocks during landing of the toy bird. These shocks can cause the body to rupture and break, the direction of travel of the toy to suddenly reverse, or the condition of the toy bird to deteriorate. Further, the presence of three slots in the body complicates the installation of the activation mechanism of the wings in the front portion in the bird and also complicates the assembly of the two portions of the body. These operations consequently require great dexterity on the part of the user of the toy bird. Finally, because of the positioning of the manipulation shaft, it becomes necessary to use both hands for releasing the toy bird into flight.

Furthermore, according to existing constructions of toy birds of this type, the stop is constituted by a simple pivoting lever. The immobilization of this pivoting lever in its two extreme positions is not very well assured. Thus, this relatively unstable lever can pivot unexpectedly and position itself in an intermediate position. This could cause premature start-up of the activation mechanism of the wings. Additionally, the operation of this mechanism may stop in the middle of flight.

SUMMARY OF THE INVENTION

The particular objective of the invention is to overcome the above-mentioned disadvantages by providing the following construction and advantages.

According to an object of the invention the flying toy includes a stop whose manipulation shaft is positioned to extend through one of the two slots provided in the body of the toy for the passage of the wing bases.

According to an object of the invention, the flying toy consists of a relatively hermetically sealed body which is not exposed to much penetration of undesirable particles, because of the absence of a slot in the lower portion of the toy.

According to a further object of the invention, the flying toy possesses a body which is less exposed to deformation, making it possible to manufacture the toy bird with reduced dimensions.

According to a further object of the invention, the toy bird does not include a lower projection which might cause reversal of the travel direction of the toy bird when it comes into contact with the ground. Thus, the toy bird can slide on the ground without the risk of getting caught on something.

According to a further object of the invention, the toy bird is equipped with a stop whose manipulation shaft is not exposed to shocks during landing of the toy.

According to a further object of the invention, the toy bird can be released to fly through the air using only one hand.

According to a further object of the invention, the positioning of the activation mechanism for the wings in the front portion of the body of the toy and the assembly of the two portions of the body is made considerably easier.

According to an embodiment of the present invention, a flying toy, which can move through the air by flapping its wings consists of a body having at least one opening, at least one flexible wing which can flap to move the flying toy through the air connected to the body and power means for storing power for flapping the at least one flexible wing. The toy bird further includes activation means connected to the power means for activating the flapping of the at least one flexible wing by the power means. The at least one oscillating wing base is secured to the at least one flexible wing through the at least one opening. The bird also includes wind-up means for winding the power means and latching means for neutralizing the activation means before the flying toy is released to fly. The latching means includes a manipulation shaft which extends through the at least one opening.

The body includes a front portion and a rear portion which can be connected to one another. The wind-up means is positioned in the rear portion. The power means consists of an elastic band adapted to be twisted for supplying power to the flying toy.

The flying toy further includes a tail flap connected to the rear portion which can be oriented in different directions to operate as a rudder.

The front and rear portions are adapted to be nested within one another and each of the front and rear portions comprise a groove which is adapted to be superimposed on one another.

The activation means consists of an annular armature for fitting the activation means in a reinforced groove formed by the grooves of the front and rear portions.

The front portion has an open end and two front lateral cut-out portions, each of which opens at the open end of the front portion. The rear portion has an open end and two rear lateral cut-out portions, each of which opens at the open end of the rear portion. Then the front and rear portions are nested within one another, the two rear lateral cut-out portions cooperate with the two front lateral cut-out portions to form the at least one opening.

The front portion includes at least one notch and the rear portion includes at least one tooth which corresponds to the at least one notch. The least one notch is adapted to be nested within the at least one tooth. The at least one notch consists of two notches slightly spaced apart from one another and the at least one tooth consists two teeth slightly spaced apart from one another. The least one notch and the at least one tooth are provided in the upper middle portion of the periphery of the front and rear portions, respectively. Alternatively, the at least one notch and the at least one tooth are provided in the lower portion of the periphery of the front and rear portions, respectively. The at least one notch is provided at a rear section of the front portion and the at least one teeth is provided at a front section of the rear portion.

The front portion includes two projections into its interior which corresponds to the at least one notch and a space provided between the two projections. The armature includes at least one head provided at the periphery of the armature which is to be positioned in the space.

The front portion includes an arched wall which is positioned at the edge of a rear opening in the front portion for increasing rigidity of the front portion and retaining the activation means in the front portion.

The activation means includes two oscillating wing bases. Each wing base has an opening by which the oscillating wing base is mounted on a first axis and one end which is adapted to receive a wing beam to which a wing is connected. The manipulation shaft is pivotably mounted on one of the first axes supporting the two oscillating wing bases.

The latching means includes a catch connected to the manipulation shaft for blocking the flapping of the at least one oscillating wing. The catch includes a first orifice. A second orifice is provided in the manipulation shaft. A flexible blade is connected between the catch and the manipulation shaft. When the flexible blade is in an extended position, the distance between the center of the first orifice of the catch and the second orifice of the manipulation shaft is larger than the distance between the centers of second axes which support the manipulation shaft and the catch.

The activation means includes a frame connected to the armature by the axes supporting the manipulation shaft and the catch. The catch is mounted to pivot about a one of the second axes and the manipulation shaft is mounted to pivot about another of the second axes. The one of the second axes which supports the catch is positioned beneath the another of the second axes which supports the manipulation shaft.

The activation means includes a wind-up lever adapted to travel along a circular trajectory. The catch includes a latching finger which is adapted to move into the circular trajectory of the wind-up lever for stopping the wind-up lever from moving further along the circular trajectory. The wind-up lever includes a tip which is adapted to cooperate with the latching finger. The tip has a surface which abuts the latching finger which has a radiant convex profile having a radius of curvature which is substantially equal to the distance between the center of the one of the second axes and the position on the latching finger which abuts the surface.

The latching means is constructed and arranged such that when the manipulation shaft is pressed in an upward direction, the latching finger moves into the circular trajectory and when the manipulation shaft is pressed in a downward direction, the latching finger moves out of the circular trajectory, thereby allowing the wings to flap, wherein the bird can be placed in flight using only one hand.

The activation means also includes a crank shaft which has one end journalled on the wind-up lever, two opposed axes and two slides. The two opposed axes are oriented substantially perpendicular to and extending in opposite directions from a second end of the crank shaft for supporting the oscillating wing bases. A second end of each wing base has a slot which is inserted on one of the opposed axes. The two slides are positioned on opposite sides of the crank shaft from one another and secured to the annular armature for guiding the path of the two opposed axes. When the oscillating wing bases oscillate upwardly and downwardly to flap the wings, the axes move in upwardly and downwardly direction within the two slides.

According to one embodiment of the present invention, a flying toy which can move through the air by flapping its wings includes a body having at least one opening, at least one flexible wing which can flap to move the flying toy through the air connected to the body, and power means for storing power for flapping the at least one flexible wing. The toy also includes activation means connected to the power means for activating the flapping of the at least one flexible wing by the power means. The at least one oscillating wing is secured to the activation means through the at least one opening. The toy also includes wind-up means for winding the power means and latching means for neutralizing the activation means before the flying toy is released to fly. The latching means is constructed and arranged such that activation of the flying toy to cause flight can be accomplished using only one hand.

BRIEF DESCRIPTION OF DRAWINGS

The objects, characteristics and advantages discussed above, as well as others, will become clear from the description which follows and the annexed drawings, in which:

FIG. 10 is a partial side view illustrating the positioning of the manipulation shaft of the stop;

FIG. 11 is a transverse cross-sectional view, along line 11—11 of FIG. 10;

FIG. 12 is a rear view of the activation mechanism of the wings and of the stop positioned so as to allow the operation of the activation mechanism;

FIG. 13 is a view similar to that of FIG. 12, illustrating the stop positioned in a neutralized position of the activation mechanism of the wings;

FIG. 14 is a diametral cross-section view along lines 14—14 of FIG. 12, illustrating the mechanism installed in the body of the toy bird, partially shown;

FIG. 17 is a detailed view, from the front and with partial breakaway, illustrating the conformity of the tip of the activation lever mechanism for activating the wings and the use of this configuration.

DESCRIPTION OF PREFERRED EMBODIMENTS

Figure 1:
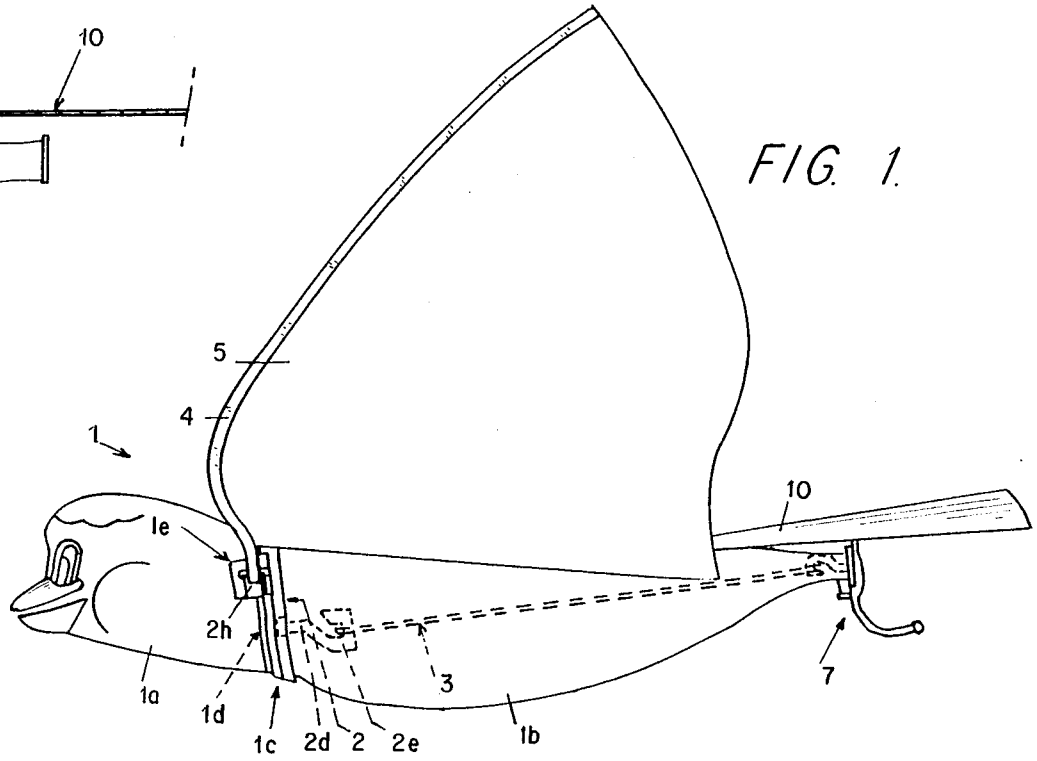
FIG. 1 is a perspective view of the flying toy according to the invention which, according to the embodiment illustrated, is presented in the form of a bird.
Figure 2:
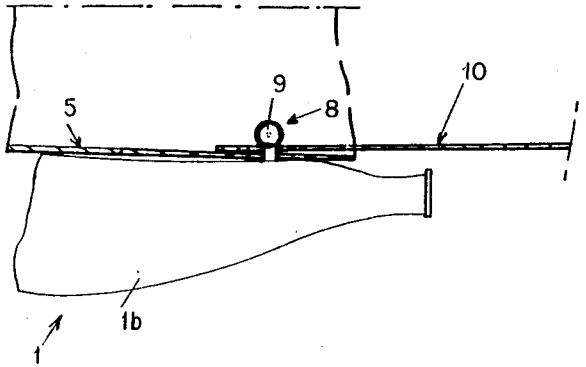
FIG. 2 is a detailed and perspective view illustrating the attachment of the rear portion of the principle flap and the orientable tail flap to the body of the bird.

Referring to the drawings for a description of one useful embodiment, which is presented as being in no way limiting, of the toy according to the invention which, preferably, has the appearance of a small bird.

The toy bird includes hollow body 1 having an elongated shape. Body 1 is normally made of any appropriate plastic material, by any appropriate molding process which is adapted to the nature of the plastic material. Hollow body 1 is formed from two portions 1*a* and 1*b*. The two portions 1*a* and 1*b* can be connected together in a nested relationship to assemble the bird. The rear end of the front position 1*a* of the body is provided with peripheral rib 1*c*. The front end of the rear portion 1*b* is provided with annular internal groove 1*d* which engages peripheral rib 1*c* when peripheral rib 1*c* is nested within the front end of rear portion 1*b*, that is, within groove 1*d*.

Figure 6:
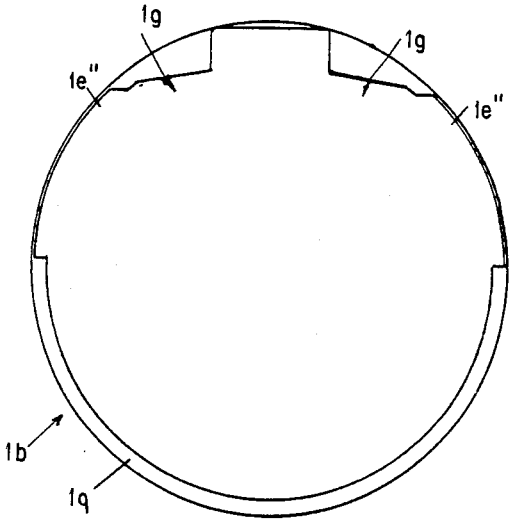
FIG. 6 is front view of the front end of the rear portion of the toy bird.
Figure 4:
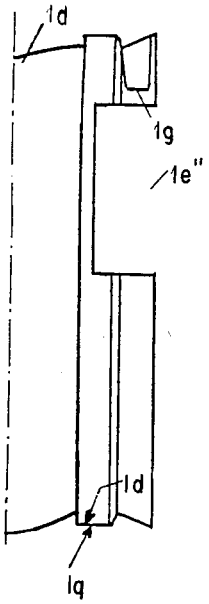
FIG. 4 is a detailed view in longitudinal partial cross-section of a front end of the rear portion of the body of the toy bird.
Figure 3:
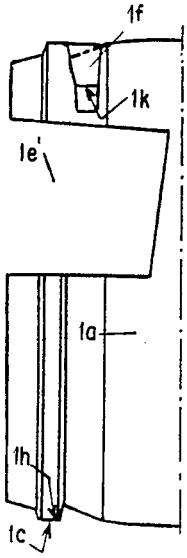
FIG. 3 is a detailed view in longitudinal partial cross-section of a rear end of the front portion of the body of the toy bird.
Figure 5:
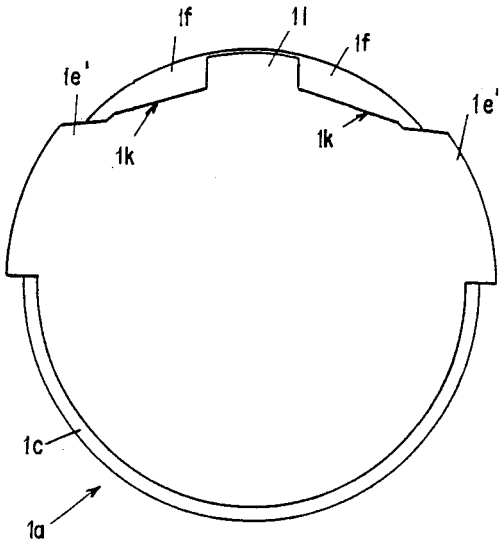
FIG. 5 is a front view of the rear end of the front portion of the body of the toy bird.
Figure 7:
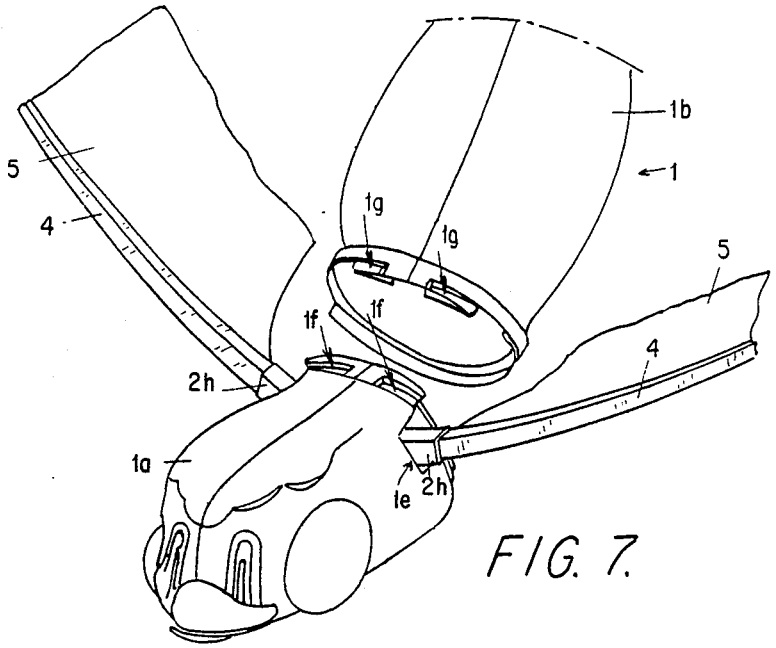
FIG. 7 is a partial perspective view of the two portions of the body of the toy bird before their assembly.

Front and rear portions 1*a* and 1*b* include lateral opening or cut-outs 1*e*′ and 1*e*″, respectively, as shown most clearly in FIGS. 5 and 6. Cut-outs 1*e*′ and 1*e*″ open toward the ends of the junction of front and rear portions 1*a* and 1*b*. These openings or lateral cut-outs, particularly openings 1*e*′ which are provided in front portion 1*a*, allow for the mechanical wind-up of the activation mechanism of the wings in front portion 1*a*.

After assembly of front and rear portions 1*a* and 1*b*, the openings or cut-outs form two lateral slots 1*e*, as shown in FIG. 1. Lateral slots 1*e* are positioned in the vicinity of the nesting of the two portions, and extend in front thereof. The passage of the wing bases of the activation mechanism of the wings pass through the two lateral slots 1*e*.

The ends of front portion 1*a* and rear portion 1*b* of body 1 which are to be joined together include complimentary grooves or notches, and teeth, which are slightly spaced from one another. These grooves and teeth constitute, simultaneously, means opposing the rotation of one of the portions with respect to the other and means favoring the reciprocal positioning and nesting of the portions during their assembly. They are positioned at the outer periphery of front portion 1*a* and rear portion 1*b*. They may be positioned at the lower middle portion of the periphery of front portion 1*a* and rear portion 1*b*.

However, preferably, these notches and teeth have complimentary shapes and dimensions and are positioned on the upper portion of the body, between the two lateral slots 1*e* which are reserved for the passage of the wing bases of the activation mechanism of the wings. The upper portion of front portion 1*a* includes, for example, two notches 1*f* slightly spaced from one another. Notches 1*f* open toward the exterior of the body of the toy and are positioned in front of the peripheral rib 1*c*. The upper portion of rear portion 1*b* is provided with two teeth 1*g* which are slightly spaced from one another. Teeth 1*g* are directed toward the interior of the body and are positioned in front of the annular internal groove 1*d*.

Two projections 1*k*, which project into the interior of front portion 1*a*, correspond to notches 1*f*, which are open at the exterior of the body and which are located at the rear section of the front portion 1*a* of the body. An opening 11 is provided between the two projections 1*k*.

Figure 8:
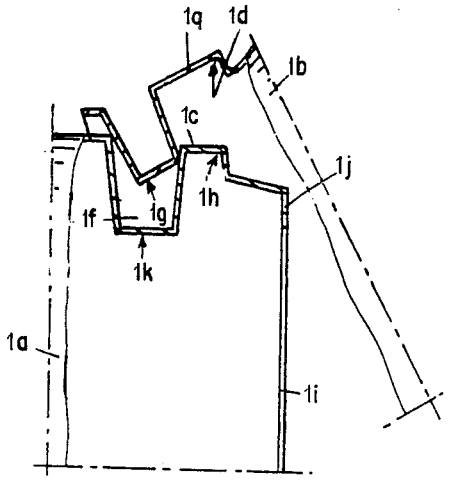
FIG. 8 is a partial longitudinal cross-sectional schematic view illustrating the pre-positioning of the two portions of the body of the toy bird before complete assembly thereof.

During the assembly of two portions 1*a* and 1*b* of the body, the junction ends of the two portions are first positioned in contact with one another at their upper portion only, so that teeth 1*g* of rear portion 1*d* are positioned in notches 1*f* of front portion 1*a* (as shown in FIG. 8).

Figure 9:
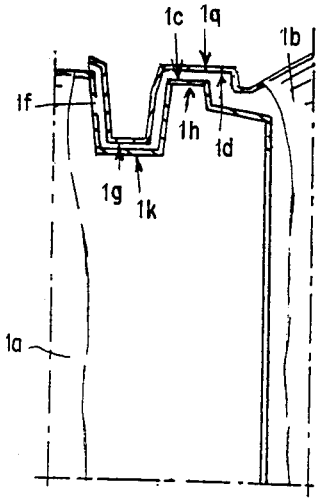
FIG. 9 is a partial longitudinal cross-sectional schematic view illustrating the front and rear portions of the toy bird in their assembled form.

Then the two portions 1*a* and 1*b* are pressed against one another. In this manner, the rear section of front portion 1*a* nests very easily in the front section of rear portion 1*b* (as shown in FIG. 9). Teeth 1*g* and notches 1*f* act as a hinge allowing for the proper positioning of front and rear portions 1*a* and 1*b* of body 1 during nesting.

Furthermore, complimentary teeth 1*g* and notches 1*f* efficiently oppose any possible rotation of one of the portions of the body with respect to the other while they are under the effect of the resulting torsional movement of the rubber band motor or under the torsional movement for caused by the relaxing thereof.

The activation mechanism of the wings, designated in its entirety by reference 2, is installed in the rear portion of front portion 1*a* of body 1. Mechanism 2, as shown in FIG. 14, includes annular armature 2*a* which is adapted to mate with the transverse section of rear portion 1*b*. Annular armature 2*a* is provided with peripheral shoulder 2*b* lodged in groove 1*h* formed by the annular internal depression corresponding to peripheral rib 1*c*. The edge of rear opening 1*i* of front portion 1*a* of the body is provided with arched wall 1*j* which projects toward the center of the opening. Wall 1j has a low height, as measured from the inside surface of front portion 1a. Wall 1j increases the rigidity of front portion 1a and cooperates in the retention of activation mechanism 2 of the wings in front portion 1a. Furthermore, annular armature 2a includes, at its periphery and at its upper portion, at least one head which projects above annular armature 2a. According to the example illustrated in FIGS. 12 and 14, two small converging heads 2p projecting above armature 2a are lodged in opening 11 and are provided between bumps 1k which front portion 1a includes in its interior portion.

It is understood that, as a result of this construction, the activation mechanism of the wings is firmly positioned and encased in the body of the bird.

Activation mechanism 2 can not rotate on its axis because of the abutting action exerted by projections 1k against heads 2p which are engaged between projections 1k. The activation mechanism 2 can not be displaced axially because it is solidly anchored in groove 1h whose external surface constitutes rib 1c. Rib 1c is reinforced by superimposed rib 1q which corresponds to annular groove 1d. Armature 2a is thus solidly encased in a reinforced groove of the body which is formed by two superimposed thicknesses of the body.

Activation mechanism 2 also includes bearing 2c which is constructed so as to be rigidly integral with armature 2a. The revolving shaft of wind-up drive lever 2d is mounted within bearing 2c. The rear end of lever 2d is made in the form of hook 2e. One end of elastic band 3 is attached to hook 2e. Elastic band 3 constitutes the motor element of the bird and stores the power to move the flying toy through the air. The other end of elastic band 3 is attached to the hook of the handle of wind-up system 7 installed in rear portion 1b of body 1 of the toy bird, as shown in FIG. 1. To send the toy bird into flight, elastic band 3 is twisted using wind-up system 7 to store the power and when elastic band 3 is released, power is released as elastic band 3 is untwisted.

One end of crank shaft 2f is journalled on drive lever 2d. The other end of crank shaft 2f is provided with two opposed axes 2g oriented perpendicularly to, and extending in opposite directions from crank shaft 2f, as shown in FIG. 14. On each of these axes is journalled, by means of a small longitudinal slot, one of the ends of a lever, or oscillating wing base 2h. The second end of each wing base 2h is connected or formed so that it can be connected, for example by nesting, to one of the wing beams or frame 4. The front edge of the main flap 5 is attached to frame 4 to constitute the flexible wings of the toy. Each wing base 2h is mounted with the ability to oscillate about an axis 2i which is rigidly integral with armature 2a.

The oscillating wing bases 2h are positioned to extend through lateral slots 1e of body 1.

The axes 2g, which are connected so as to oscillate the wing bases, are positioned and guided in two slides 2j and 2k. One axis 2g is positioned in a first slide 2j which is oriented diametrically and rigidly integral with armature 2a. The other axis 2g is positioned in a second slide 2k positioned symmetrically opposed to first slide 2j and is provided within counter frame 21. Frame 21 is rigidly connected to adhere to principle armature 2a of the mechanism 2 by a linkage system. Armature 2a includes, for example, four cylindrical heads or axes 2i and 2m which are force fitted in holes or small sleeves which are located in frame 21. Axes 2i serve, as previously indicated, as supports for the oscillating wing bases.

A latching apparatus or stop 6 makes it possible to neutralize activation mechanism 2 of the wings during operation necessary to wind-up the toy bird and before the toy bird is released to fly.

Figure 16:
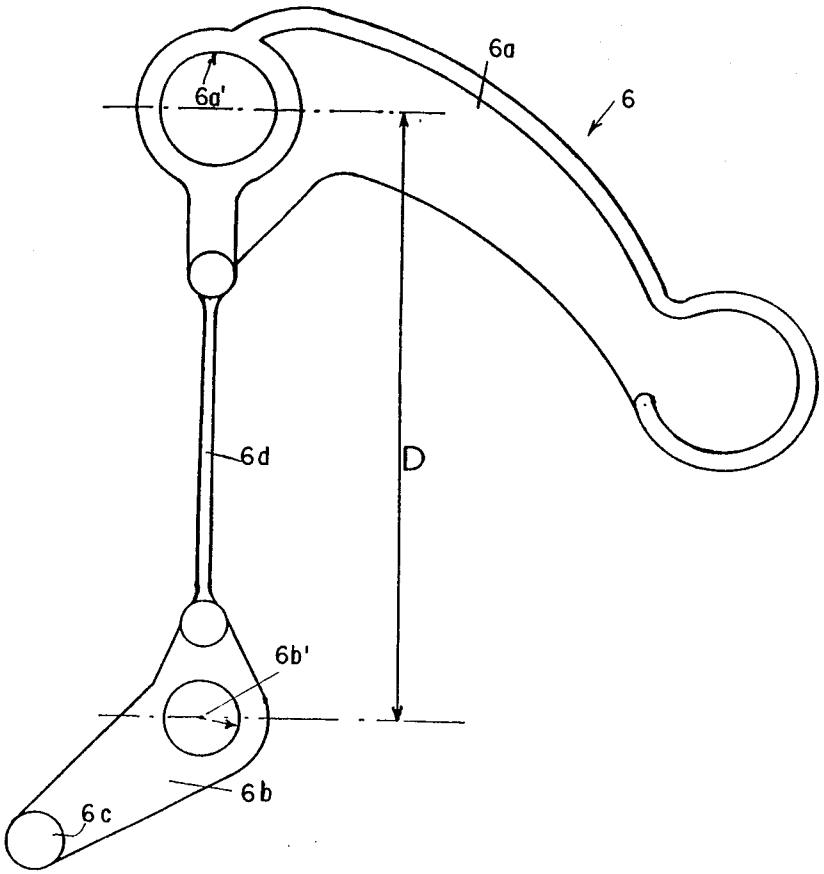
FIG. 16 is a front view of the stop.
Figure 15:
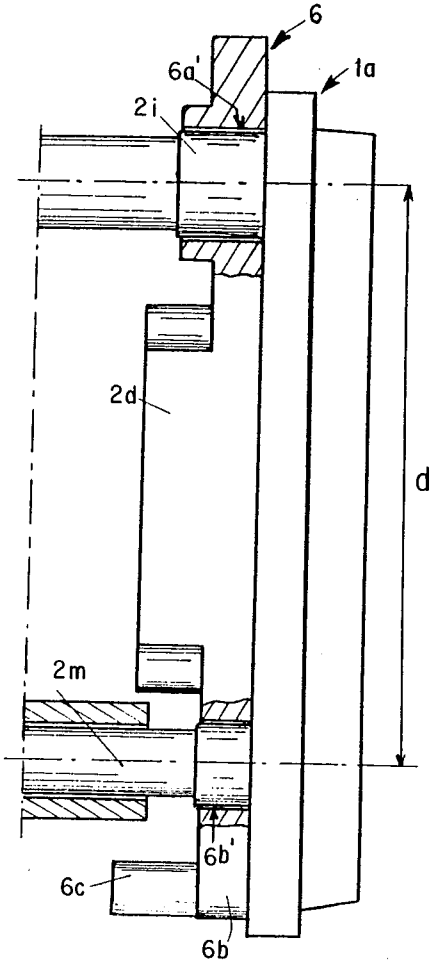
FIG. 15 is a cross-sectional view along line 15—15 of FIG. 12.

This stop, designated in its entirety by reference 6 as shown by itself in FIG. 16, includes a pivotable manipulation shaft 6a. According to an important aspect of the invention, manipulation shaft 6a is positioned through one of two slots, or openings 1e provided in the body 1, for the passage of the oscillating wing bases 2h. In this way, it is possible for the user to activate the toy bird to place it into flight using the same hand as that used to hold the toy.

It will be understood, as a result, that after the wind-up of mechanism 2, the toy bird can be held in one hand, between the thumb and index finger. It is then easy to activate manipulation shaft 6a of the stop by using the middle finger.

Stop 6 further includes a pivotable blockage catch 6b whose free end includes latching finger 6c. Blockage catch 6b is connected to the pivotable manipulation shaft 6a by means of a blade spring constituted by a flexible blade 6d. Flexible blade 6d, blockage catch 6b and manipulation shaft 6a are molded from a single piece of material.

Manipulation shaft 6a is mounted so that it is pivotable on one of the axes 21 which serves as a support for one of the oscillating wing bases 2h. Blockage catch 6b is installed on the cylindrical head or underneath adjacent axis 2m so as to pivot about a latitudinal axis. In this manner the linkage between principle armature 2a and frame 21 is assured.

Stop 6 is dimensioned in a manner such that distance D (see FIG. 16) which separates the centers of orifices 6a' and 6b', or other pivotable wind-up means of the manipulation shaft 6a and of blockage catch 6b, respectively, is greater than the distance d which separates the centers of cylindrical heads or axes 2i and 2m on which are installed manipulation shaft 6a and blockage catch 6b, respectively. The distance D is measured when flexible blade 6d is in a rigid, straight position. As a result, the flexible blade 6d, which connects the shaft 6a and blockage catch 6b is adaptable to assume only two stable concave configurations. One of the two concave configurations is on one side of an imaginary line joining the centers of axes 2i and 2m, and the other of the configurations is on the other side of this imaginary line. Each of the two configurations correspond to one of the two positions of manipulation shaft 6a and of blockage catch 6b. Pivoting manipulation shaft 6a in one direction causes blockage catch 6b to pivot in the opposite direction.

For example, when manipulation shaft 6a is pivoted upwardly as shown in FIG. 13, blockage catch 6b is pivoted upwardly into a position in which latching finger 6c is positioned on the circular trajectory of the wind-up lever 2d of the mechanism for activating the wings of the toy bird. Thus blockage catch 6b stops the rotation of wind-up lever 2d which abuts against latching finger 6c. When manipulation shaft 6a is pivoted downwardly, as shown in FIG. 12, spring blade 6b causes blockage catch 6b to pivot in the opposite direction. Latching finger 6c is then positioned outside of the trajectory of the wind-up lever or handle 2d, thus allowing handle 2d to turn normally, in an unrestricted manner.

The stop 6 thus formed and installed provides the advantage of substantial positional stability offered by the spring blade 6*d* which can only occupy two positions, one of which assures the neutralization of the activation mechanism of the wings and the other which allows for the operation thereof.

Handle 2*d*, as shown in FIG. 17, is provided with tip 2*n* which is adapted to cooperate with latching finger 6*c* of blockage catch 6*d*. The surface 2*o* of the tip 2*n* is adapted to abut on the latching finger 6*c* and has a convex radiant profile whose radius of curvature, r, is equal or substantially equal to the distance dl separating the pivot axis of latching finger 6*c* and the generator of contact thereof, that is, the point on the surface 2*o* which contacts latching finger 6*c*, as shown in FIG. 17. The radius of curvature is a measurement of the degree of curvature of the surface 2*o* of tip 2*n*. This structure allows blockage catch 6*d* to be pressed downwardly without requiring any substantial effort.

In a known fashion, the principle flap 5 of the toy bird is formed from a single piece, or film, of plastic flexible material. Flap 5 preferably assumes the form and appearance of the open wings of a bird. The front edge of each wing of flap 5 is attached in some manner, for example with glue, to the upper surface of wing beam 4.

One end of flap 5 is fastened to body 1 of the toy bird by the internal ends of wing beams 4 to which flap 5 is attached. The internal ends of wing beams 4 are attached or adapted to be attached to the wing bases 2*h* of the mechanism 2, as previously indicated. The other end of flap 5 includes a small median slit provided adjacent to the rear edge. This slit is inserted on stub 8 provided the upper surface of the rear portion of body 1. In this manner, the other end of flap 5 is fastened to body 1 of the toy bird.

Stub 8 includes spherical head 9. Tail flap or rudder 10 of the toy bird is attached to spherical head 9. The armature of rudder 10 consists of a split ring which allows for friction mounting of tail flap 10 on the rear portion of body 1 of the toy so that rubber 10 can be oriented in various positions to guide the direction of flight of the toy bird. Spherical head 9 thus serves as a means of attachment of the principle flap 5 and of the auxiliary flap 10 of the toy bird.

To send the bird into flight, manipulation shaft 6*a* of stop 6 is placed in its upward position using the hand which is holding the bird below the wings, for example. In this way, latching finger 6*c* of blockage catch 6*b* is moved into the circular trajectory of wind-up drive lever 2*d* to block its path. Then, elastic band 3 is twisted, or wound, using wind-up system 7 to store the power necessary for flight. Using the hand holding the bird, manipulation shaft 6*a* is pushed downwardly to allow passage of wind-up drive lever 2*d*, and thereby start the flapping of the wings. The bird is then sent into flight, using the same hand. Thus, the position of manipulation shaft 6*a* allows the bird to be easily sent into flight.

Although the invention has been described with respect to particular means, materials and embodiments, it is to be understood that the invention is not limited to the particular disclosed and extends to all equivalence within the scope of the claims.

I claim:

1. A flying toy adapted to move through the air by flapping at least one wing, said flying toy comprising:

a. a body having at least one opening;

b. at least one flexible wing connected to said body, said at least one flexible wing being adapted to flap to move said flying toy through the air;

c. power means for storing power for flapping said at least one flexible wing;

d. activation means connected between said power means and said at least one flexible wing for activating the flapping of said at least one flexible wing by said power means, said at least one flexible wing being secured to said activation means, said activation means being extended through said at least one opening;

e. wind-up means for winding said power means; and f. latching means for neutralizing said activation means before said flying toy is released to fly, said latching means comprising a manipulation shaft which extends through said at least one opening through which said activation means is extended.

2. The flying toy according to claim 1 wherein:

a. said body comprises a front portion and a rear portion adapted to be connected to one another;

b. said wind-up means being positioned in said rear portion; and c. said power means comprises an elastic band adapted to be twisted for supplying power to said flying toy.

3. The flying toy according to claim 2 further comprising a tail flap connected to said rear portion and adapted to be oriented in different directions to operate as a rudder.

4. The flying toy according to claim 2 wherein said front and rear portions are adapted to be nested within one another and each of said front and rear portions comprise a groove which is adapted to be superimposed on one another.

5. The flying toy according to claim 4 wherein said activation means comprises an annular armature for fitting said activation means in a reinforced groove formed by said grooves of said front and rear portions.

6. The flying toy according to claim 5 wherein:

a. said front portion comprises at least one notch; and b. said rear portion comprises at least one tooth which corresponds to said at least one notch wherein said at least one notch is adapted to be nested within said at least one tooth.

7. The flying toy according to claim 6 wherein:

a. said at least one notch comprises two notches slightly spaced apart from one another; and b. said at least one tooth comprises two teeth slightly spaced apart from one another.

8. The flying toy according to claim 6 wherein said at least one notch and said at least one tooth are provided in the upper middle portion of the periphery of said front and rear portions, respectively.

9. The flying toy according to claim 6 wherein said at least one notch and said at least one tooth are provided in the lower portion of the periphery of said front and rear portions, respectively.

10. The flying toy according to claim 6 wherein:

a. said at least one notch is provided at a rear section of said front portion; and b. said at least one tooth is provided at a front section of said rear portion.

11. The flying toy according to claim 6 wherein:

a. said front portion comprises:

i. two projections into its interior which corresponds to said at least one notch; and ii. a space provided between said two projections; and b. said armature comprises at least one head provided at the periphery of said armature and adapted to be positioned in said space.

12. The flying toy according to claim 6 wherein said front portion comprises an arched wall which is positioned at the edge of a rear opening in said front portion for increasing rigidity of said front portion and retaining said activation means in said front portion.

13. The flying toy according to claim 4 wherein:

a. said front portion comprises an open end and two front lateral cut-out portions, each of which opens at said open end of said front portion; and b. said rear portion comprises an open end and two rear lateral cut-out portions, each of which opens at said open end of said rear portion, wherein when said front and rear portions are nested within one another, said two rear lateral cut-out portions cooperate with said two front lateral cut-out portions to form said at least one opening.

14. The flying toy according to claim 5 wherein:

a. said activation means comprises two oscillating wing bases, each wing base having an opening by which the flexible wing base is mounted on a first axis and one end which is adapted to receive a wing beam to said at least one flexible wing is connected; and b. said manipulation shaft is pivotably mounted on one of said first axes supporting said two oscillating wing bases.

15. The flying toy according to claim 14 wherein said latching means comprises:

a. a catch connected to said manipulation shaft for blocking the flexible of said at least one flapping wing, said catch comprising a first orifice, b. a second orifice provided in said manipulation shaft; and c. a flexible blade connected between said catch and said manipulation shaft, wherein when said flexible blade is in an extended position, the distance between the center of said first orifice of said catch and said second orifice of said manipulation shaft is larger than the distance between the centers of second axes which support said manipulation shaft and said catch.

16. The flying toy according to claim 15 wherein said activation means comprises a frame connected to said armature by said axes supporting said manipulation shaft and said catch, said catch being mounted to pivot about a one of said second axes and said manipulation shaft being mounted to pivot about another of said second axes, wherein said one of said second axes supporting said catch is positioned beneath said another of said second axes supporting said manipulation shaft.

17. The flying toy according to 16 wherein:

a. said activation means comprises a wind-up lever adapted to travel along a circular trajectory;

b. said catch comprises a latching finger adapted to move into said circular trajectory of said wind-up lever for stopping said wind-up lever from moving further along said circular trajectory;

c. said wind-up lever comprises a tip adapted to cooperate with said latching finger, said tip having a surface which abuts said latching finger, said surface having a radiant convex profile having a radius of curvature which is substantially equal to the distance between the center of said one of said second axes and the position on said latching finger which abuts said surface.

18. The flying toy according to claim 17 wherein said latching means is constructed and arranged such that when said manipulation shaft is pressed in an upward direction, said latching finger moves into said circular trajectory and when said manipulation shaft is pressed in a downward direction, said latching finger moves out of said circular trajectory, thereby allowing said wings to flap, wherein said bird can be placed in flight using only one hand.

19. The flying toy according to claim 16 wherein said activation means further comprises:

a. a crank shaft having one end journalled on said wind-up lever;

b. two opposed axes oriented substantially perpendicular to and extending in opposite directions from a second end of said crank shaft for supporting said oscillating wing bases, a second end of each wing base having a slot which is inserted on one of said opposed axis;

c. two slides positioned on opposite sides of said crank shaft from one another and secured to said annular armature for guiding the path of said two opposed axes, wherein when said oscillating wing bases oscillate upwardly and downwardly to flap the wings, said axes move upward and downward within said two slides.

* * * * *

UNITED STATES PATENT AND TRADEMARK OFFICE

CERTIFICATE OF CORRECTION

PATENT NO. : 4,729,748

DATED : March 8, 1988

INVENTOR(S) : Gerard VAN RUYMBEKE

It is certified that error appears in the above-identified patent and that said Letters Patent is hereby corrected as shown below:

At column 3, line 15, change "Then" to ---When---.
At column 3, line 22, insert "at" after ---The---.
At column 3, line 26, insert ---of--- after "consists".
At column 5, line 9, insert ---a--- after "FIG 6 is".
At column 6, line 58, change "for" to ---force---.
At column 8, line 29, change "21" to ---2i---.
At column 8, line 34, change "21" to ---2i---.

Signed and Sealed this

Twenty-eighth Day of February, 1989

*Attest:*

DONALD J. QUIGG

*Attesting Officer*

*Commissioner of Patents and Trademarks*